US006252554B1

(12) United States Patent
Isohätälä et al.

(10) Patent No.: US 6,252,554 B1
(45) Date of Patent: Jun. 26, 2001

(54) ANTENNA STRUCTURE

(75) Inventors: Anne Isohätälä, Kello; Suvi Tarvas; Jyrki Mikkola, both of Oulu, all of (FI)

(73) Assignee: LK-Products Oy, Kempele (FI)

( * ) Notice: Subject to any disclaimer, the term of this patent is extended or adjusted under 35 U.S.C. 154(b) by 0 days.

(21) Appl. No.: 09/589,309

(22) Filed: Jun. 7, 2000

(30) Foreign Application Priority Data

Jun. 14, 1999 (FI) ..... 991359

(51) Int. Cl.[7] ..... H01Q 1/50
(52) U.S. Cl. ..... 343/700 MS; 343/702; 455/90
(58) Field of Search ..... 343/700 MS, 702; 455/90

(56) References Cited

U.S. PATENT DOCUMENTS

| | | | | |
|---|---|---|---|---|
| 5,327,151 | | 7/1994 | Egashira . | |
| 5,945,952 | * | 8/1999 | Davidson | 343/702 |
| 6,031,496 | * | 2/2000 | Kuittinen et al. | 343/702 |

FOREIGN PATENT DOCUMENTS

| | | | |
|---|---|---|---|
| WO 97/49141 | 12/1997 | (WO) | H01Q/1/36 |
| WO 98/65066 | 12/1998 | (WO) | H01Q/1/24 |
| WO 99/031 | 1/1999 | (WO) | H01Q/1/24 |

OTHER PUBLICATIONS

Abstract of *Electronics and Communications in Japan*, Part 1, vol. 80, No. 8, sivuilla 39–49, Aug. 1997.
Abstract of *Transactions of the Institute of Electronics, Information and Communication Engineers B–2*, vol. J81B–2, No. 10 Sivut 897–905, Oct. 1998.
Abstract of *National Technical Report*, vol. 42, No. 1, sivuilla 143–148, Feb. 1996.

* cited by examiner

*Primary Examiner*—Hoanganh Le
*Assistant Examiner*—James Clinger
(74) *Attorney, Agent, or Firm*—Darby & Darby

(57) ABSTRACT

The invention relates to dual mode antennas particularly suitable for mobile stations. The antenna structure comprises an antenna (211, 201, 202, 212) of the PIFA type which is located within the covers of the mobile station, and a whip element (220) which is movable relating to the PIFA antenna. The PIFA can be a single band or a dual band antenna. When the whip element is extracted its lower end (222) forms a galvanic or capacitive coupling with the radiating element (211) of the PIFA. If the PIFA is a single band antenna the extracted whip element substantially changes the resonant frequency of the PIFA, so that the whip is left as the radiating element at the operating band. If the PIFA is a dual band antenna, then an extracted whip alone, or the whip and the planar element of the PIFA together, functions as the radiating element at one operating band, and at the other operating band the planar element of the PIFA operates as the radiating element. The feeding and the matching of the whip element is arranged by the PIFA without any separate additional components. With the aid of the invention the best properties of both the PIFA and the monopole antenna can be utilised. The structure is further reliable and it has relatively low costs.

7 Claims, 3 Drawing Sheets

ANTENNA STRUCTURE

The invention relates to dual mode antennas particularly suitable for mobile stations. A dual mode antenna means that it has two electrical operating states and the transition between the states is performed by changing the mechanical structure of the antenna.

Of dual mode antennas there are previously known the helix/whip antenna combinations, where the whip section is either within the mobile station or extended outside it. The last mentioned position is used when required, in order to improve the quality of the connection. The helix is stationary on the frame of the mobile station, whereby the whip extends through the helix, or is located at the end of the whip, whereby both sections are movable. A disadvantage in antennas of this type is that the helix section always remains outside the mobile station where it forms an inconvenient projection.

Figure 1:
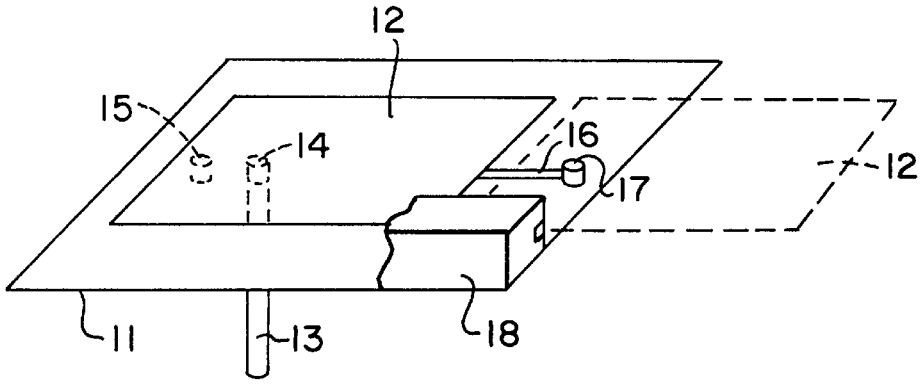
FIG. 1 PRIOR ART

From the prior art is further known, i.a. from the publication WO98/56066, a dual mode plane antenna according to FIG. 1. It contains a ground plane 11 and a radiating plane 12 raised slightly above the ground plane. The radiating plane can be moved along the grooves in a dielectric body. A peace of the grooved dielectric boy 18 is drawn in FIG. 1 so that it can be seen at one edge of the plane 12. When the plane is retracted the structure operates as an antenna of the planar inverted F-antenna (PIFA) type. Then the feeding is via the line 13 to a point 14 of the plane 12. A short circuit between the plane 12 and the ground plane 11 is made at another position 15. When the plane 12 is extracted, in the position shown in FIG. 1 by a dotted line, the structure operates as a monopole antenna. Then the feeding is via the line 13 and the transmission line 16 to the plane 12 at a point 17. This arrangement also comprises a short circuit of the transmission line 16 when the plane 12 is retracted, and an impedance matching when the plane 12 is extracted. These arrangements are not visible in FIG. 1.

A disadvantage of the above described structure is the unreliability of the galvanic connection in such positions where the other part is movable. The connection can be degraded due mechanical wear of the grooves in the dielectric body, or due to a deformation of the radiating plane as a result of the use.

The object of the invention is to reduce the mentioned disadvantages relating to prior art. The antenna structure according to the invention is characterised by what is expressed in the independent claim. Some advantageous embodiments of the invention are presented in the dependent claims.

The basic idea of the invention is as follows: The antenna structure comprises an antenna of the PIFA type, which is located within the covers of the mobile station, and whip element which can be moved in relation to the PIFA. The PIFA can be a single frequency or a dual frequency antenna. When the whip element is in the lower position it has no substantial coupling to the parts of the PIFA. When the whip element is in the upper position or extracted, then its lower end forms a galvanic or capacitive coupling with the radiating element of the PIFA. If the PIFA is a single band antenna the extracted whip element substantially changes the resonant frequency of the PIFA, so that the whip element will be the radiating element at the operating band. If the PIFA is a dual-band antenna the whip element may change one of the resonant frequencies of the PIFA, preferably the lower resonant frequency, so that only the extracted whip operates as the radiating element at the lower operating band. At the higher operating band the conductive plane of the PIFA functions as the radiating element. Alternatively the extracted whip element only improves the operation of the antenna at the lower operating band without changing the resonant frequency of the PIFA. The feeding of the whip element is arranged via the PIFA, without any additional components.

An advantage of the invention is that a mobile station provided with an antenna of the invention has no inconvenient projecting parts when the mobile station is not used for communication. However, the properties of a projecting whip element can be utilised when required. The bandwidth and the gain of the PIFA depend strongly on the distance between the planes of the PIFA. The characteristics of particularly small-sized PIFA are not necessarily sufficient in all situations. As known, a whip antenna provides a good electrical performance. By combining a PIFA and a whip antenna the best properties of both antennas can be utilised.

A further advantage of the invention is that the structure according to the invention is reliable as there are a minimum of moving parts, and even a frequent moving of the whip element corresponding to normal use does not cause any substantial changes in the electrical properties. An advantage of the invention is further that the manufacturing costs of the structure are relatively low because it is simple and suited for series production. An advantage of the invention is further that the whip element generally causes a lower specific absorption rate value (SAR) than a corresponding PIFA. Further, an advantage of the invention is that the shorting of the gap in the radiating pattern of the PIFA, which realises the change of the resonance frequency, makes the antenna less sensitive to the effects of the user's hand than a conventional PIFA or a PIFA which is not shorted by the whip.

Figure 3:
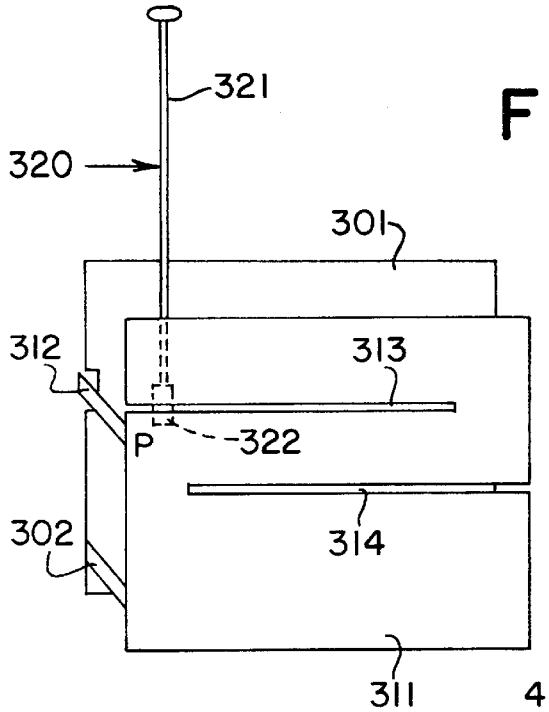
Figure 4:
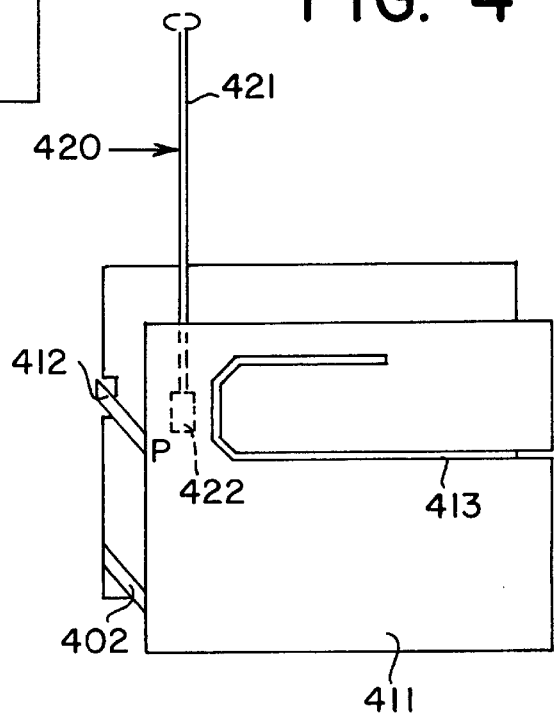
Figure 5:
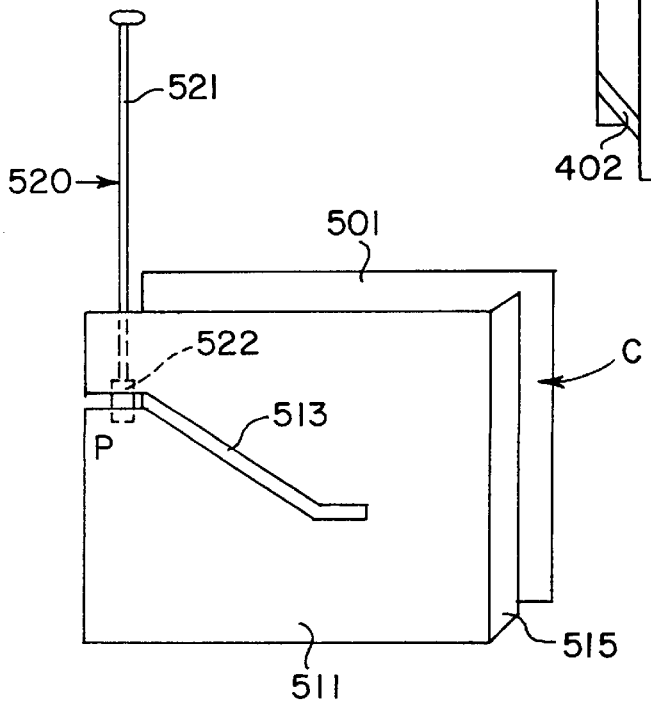
Figure 6A:
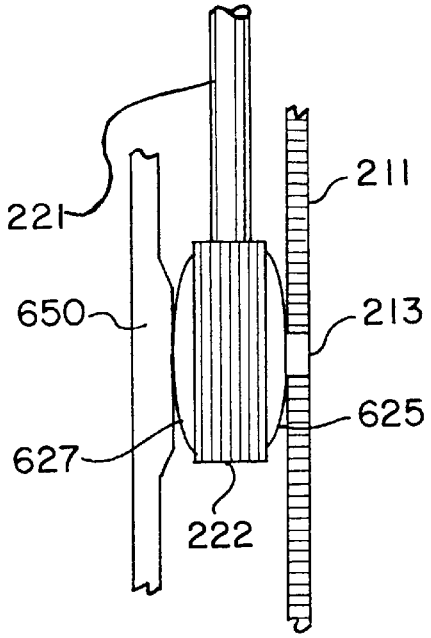
Figure 6B:
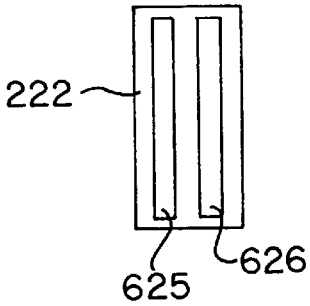
Figure 7:
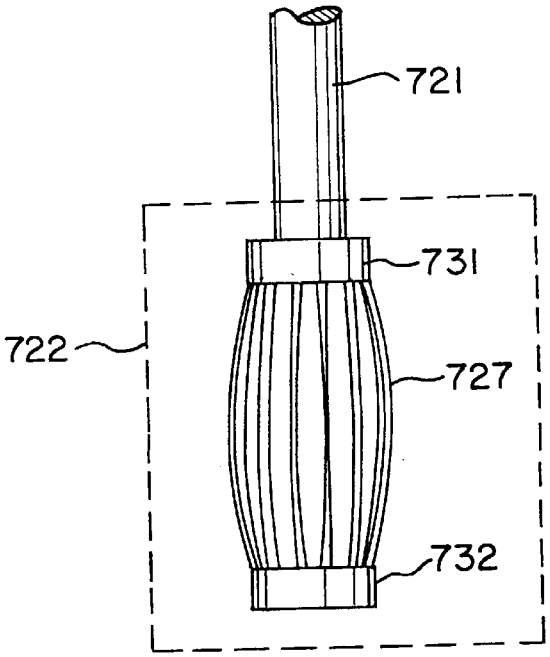

The invention is described in detail below. In the description reference is made to the enclosed drawings, in which FIG. 1 shows an example of a prior art dual mode antenna, FIG. 2*a* shows an example of an antenna according to the invention, FIG. 2*b* shows the structure of FIG. 2*a* as seen from a side, FIG. 3 shows a second example of the antenna according to the invention, FIG. 4 shows a third example of the antenna according to the invention, FIG. 5 shows an example of the matching of an antenna according to the invention, FIG. 6 shows an example of the connecting component of the whip element, and FIG. 7 shows another example of the connection component of the whip element.

FIG. 1 was described already in connection with the description of prior art.

Figure 2A:
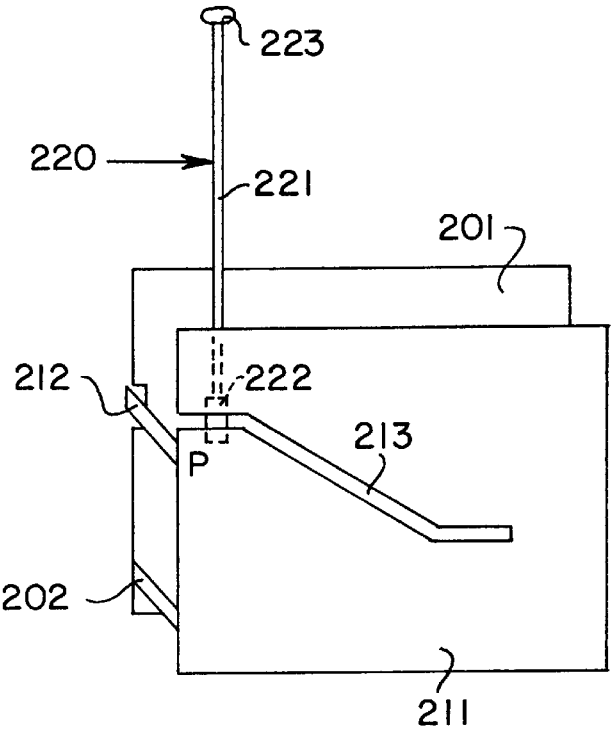

FIG. 2*a* shows an example of an antenna structure according to the invention. It comprises a ground plane 201, a radiating planar element 211 and a whip element 220. Of these the ground plane and the radiating planar element are stationary within the covers of the radio device in question, and the whip element is either within the device or extracted. The ground plane 201 can be for instance a separate metal plate or a part of the frame or metallic protective cover of said radio device. The planar element 211 has a gap 213, which is used to shape the elements conductive pattern so that the planar antenna obtains a desired resonance frequency. The gap 213 begins at an edge of the plane 211 and terminates at the centre area of the plane 211. In this example the design of the conductive pattern is such that the planar antenna is a single frequency band antenna. The planar element 211 is fed via the conductor 212 connected to its edge. Between the ground plane 210 and the plane 211 there is a shorting element 202, so that the planar antenna of the example is of the PIFA type. The whip element 220 comprises the actual radiating whip 221, a connecting component 222 at its lower end, and an expanded part 223 at the upper end of the whip which facilitates gripping. In FIG. 2*a* the whip 220 is shown in its top position, or extracted. Then the connecting component 222 is at the beginning of the gap 213 of the planar element 211. The connecting component 222 has a galvanic connection on both sides of the gap 213 of the planar element 211, and thus the gap will be shorted. Due to the shorted gap 213 the resonant frequency of the plane antenna increases substantially, and therefore the planar antenna does not function as an antenna on the operating frequency band when the whip element 220 is extracted. On the other hand the whip element is dimensioned to act as a monopole antenna on the same operating frequency band, and thus it replaces the internal planar antenna. In the operating state of FIG. 2*a* the task of the planar element 211 will be to function as a section of the feeding conductor of the whip 220 and as an element which matches the impedance of the whip.

Figure 2B:
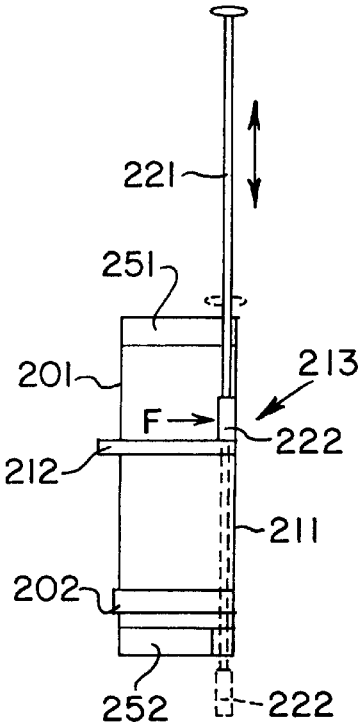

FIG. 2*b* shows the structure of FIG. 2*a* as seen from a side. The connecting component 222 of the whip element is pressed against the planar element 211 with a force F with the aid of a mechanism, of which there is an example in FIG. 6. FIG. 2*b* shows with dotted line the whip element retracted within the structure. Then it has no substantial electrical coupling to the rest of the structure, and only the planar antenna functions as an antenna. The support structure 251, 252 for the planar antenna is also drawn in FIG. 2*b*. The part 251 at the upper part of the antenna supports also the whip 221. It has a hole, in which the whip 221 can be moved in and out.

The term "radiating" refers in this description and in the claims to the intended use of the element. Of course the element does not radiate if it is not fed. A "radiating" element further also receives on the same frequency band on which it effectively can radiate.

FIG. 3 shows a second example of an antenna structure according to the invention. The structure differs from that in FIG. 2 only regarding the design of the conductive pattern of the radiating planar element. The plane element 311 of FIG. 3 has two gaps. The first gap 313 begins at a first edge of the planar element close to the feeding point P and extends in the figure horizontally to a certain distance from the opposite or second edge. The second gap 314 begins at the second edge and extends in the figure horizontally to a certain distance from the first edge of the plane element. With a suitable dimensioning of the gaps the planar antenna can obtain two different resonant frequencies; thus it operates as a dual band antenna. When the whip element 320 is extracted its connecting component 322 shorts the first gap 313 at its beginning. Then the second, preferably lower resonance frequency is substantially changed. As a result only the whip 321 functions as an antenna on the lower operating frequency band. On the upper operating frequency band the planar antenna functions as the antenna, both when the whip element is retracted and when it is extracted.

In the structures of FIGS. 2 and 3 the connecting point between the whip element and the planar element is arranged close to the feeding point P of the planar element. In this way the feeding of the whip element can be made more effective. In the shown structures the shorting of the gap of the planar element serves the same purpose. If this would not be done both the planar element and the whip would function as radiators on the operating frequency band in question when the whip is extracted. The radiating efficiency of the whip element is affected by its impedance matching to the antenna port. The feeding via the PIFA provided with a shorting conductor 202; 302 causes the impedance to change into the inductive direction. Therefore the matching may require capacitive loading. In FIG. 5 there is an example how the matching capacitance could be advantageously arranged. The structure of FIG. 5 is similar to that of FIG. 2. It comprises a ground plane 501, a radiating planar element 511, and a whip element 520, which comprises the actual radiating whip 521 and a connecting component 522. The planar element 511 has a gap 513 which is shorted by the connecting component 522. The feeding point P of the plane element is close to the shorting position of the gap 513. The difference compared to the structure of FIG. 2 is that a ledge 515 directed toward the ground plane 501, which ledge is formed by bending the planar element. The capacitance between the ledge and the ground plane is used in the matching of the impedance of the whip antenna. The matching can also be tuned e.g. by changing the dimensions of the shorting conductors 202, 302 shown in FIGS. 2 and 3.

In FIG. 4 there is a third example of the antenna structure according to the invention. Also now the structure differs from that in FIG. 2 only regarding the design of the conductive pattern of the radiating planar element. The planar element 411 of FIG. 3 has one gap 413 which begins at one edge of the planar element, extends first in the horizontal direction, then in the vertical direction relatively close to the first edge of the planar element, and then horizontally toward the second edge of the planar element up to a certain distance from it. Also in this example the gap has been shaped so that the plane antenna has two separate resonant frequencies. However, in this example the connecting component 422 of the whip element 420 does not short the gap 413 when it is extracted, but it only forms a galvanic contact to the planar element 411 close to its feeding point P. Thus the planar antenna operates on both operating frequency bands. The whip element is dimensioned to operate on the lower operating frequency band where it improves the electrical performance of the antenna.

Alternatively the coupling of the whip element can be capacitive: Then, when the whip is extracted, the planar connecting component 422 is at a certain close distance from the planar element 411 in order to obtain a suitable coupling capacitance.

FIG. 6 shows an example of how to arrange the galvanic connection between the whip element and the planar element. The figure shows the actual whip element 221, the connecting component 222, the planar element 211 and its gap 213, as in FIG. 2*b*. The FIG. 6 further shows a part of the dielectric body 650 belonging to the support structure of the planar antenna parallel with the planar element 211, and the strip springs 625 and 627 fastened to the connecting component 222. When the whip element is extracted the connecting component 222 is between the planar element 211 and the support body 650 so that the spring 625 presses the planar element and the spring presses the support body. Then the contact spring 625 forms a firmn contact with the planar element 211 on both sides of its gap 213. On one side of the main figure the FIG. 6 shows the connecting component 222 as seen in the direction from the plane element 211. It shows the contact spring 625 and further, parallel to it, a second similar contact spring 626. The double contact formed by them improves the reliability of the connection.

FIG. 7 shows another example of the connecting component of the whip element. The connecting component 722 contains arcuate contact springs, such as 727, in a cylindrical symmetric arrangement so that they form a barrel-like periphery. The contact springs are fastened to each other and to the whip 721 by support bodies 731, 732. A structure of this kind enables the whip to be rotated regarding its axis. The high number of contact springs further means an longer operating life.

Above we described some solutions according to the invention. The invention is not limited to them. The planar antenna could be of another type than PIFA. It can also comprise a parasitic element. The shape and the locking mechanism of the connecting component may vary in a wide range. In its simplest form the sleeve-like connecting component is only pulled between of the plane projections which are bent over the edges of the gap of the planar element. The inventive idea can be applied in numerous ways within the limits set forth in the independent claim.

What is claimed is:

1. An antenna structure of a radio device comprising:

a frames;

a stationary part with reference to said frame; and a movable part, with reference to said frame, said movable part being locatable substantially within a cover of the device during operation of the device, said stationary part including a ground plane (201; 301; 401; 501) and a radiating planar element (211; 311; 411; 511), said ground plane and radiating planar element being located within the cover of the device; and said movable part including a radiating whip element (220; 320; 420; 520), wherein when said radiating whip element is in an extended position, said radiating whip element is coupled with said planar element, and said coupling provides an electromagnetic feed to said whip antenna.

2. The structure according to claim 1, wherein said coupling is galvanic.

3. The structure according to claim 2, wherein:

said planar element (211; 311; 511) includes a non-conductive gap for obtaining a desired resonant frequency; and said galvanic coupling spans said gap to change a resonant frequency of the planar element.

4. The structure according to claim 2, wherein a first end of said whip element includes at least a first and a second contact spring (625, 627) connected to said first end of said whip element, and wherein when said whip element is in an extended position, said first end is located between a stationary dielectric support body (650) of the structure and said planar element (211), and wherein said first contact spring (625) contacts said dielectric support body and the second contact spring (627) contacts said plane element in order to form a galvanic coupling.

5. The structure according to claim 4, wherein said contact springs (727) are arcuate and located at substantially even intervals on a barrel-like surface at equal distances from the axis of the whip element (720).

6. The structure according to claim 1, wherein said planar element (511) includes a conductive projection (515) toward the ground plane (501) said projection matching the feeding impedance of the whip element (520).

7. An antenna structure according to any of claims 1–6, wherein said stationary part forms an antenna of the PIFA type.

* * * * *

UNITED STATES PATENT AND TRADEMARK OFFICE

CERTIFICATE OF CORRECTION

PATENT NO. : 6,252,554 B1
DATED : June 26, 2001
INVENTOR(S) : Anne Isohatala

It is certified that error appears in the above-identified patent and that said Letters Patent is hereby corrected as shown below:

Title page,
Item [73], Assignee, name change, "LK Products Oy, Kempele, Finland" to --.Filtronic LK Oy, Kempele, Finland --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*